US006449454B1

(12) United States Patent
Ito

(10) Patent No.: US 6,449,454 B1
(45) Date of Patent: Sep. 10, 2002

(54) IMAGE FORMING APPARATUS

(75) Inventor: Yoshikuni Ito, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/854,564

(22) Filed: May 15, 2001

(30) Foreign Application Priority Data

May 17, 2000 (JP) ..... 2000-145599

(51) Int. Cl.[7] ..... G03G 15/01; G03G 15/00

(52) U.S. Cl. ..... 399/303; 399/45; 399/304; 399/388

(58) Field of Search ..... 399/389, 390, 399/388, 45, 298, 299, 303, 304, 312

(56) References Cited

U.S. PATENT DOCUMENTS 5,140,375 A * 8/1992 Shindo et al. ..... 399/45
5,983,041 A * 11/1999 Otaki et al. ..... 399/45
6,347,209 B1 * 2/2002 Bessho ..... 399/303

* cited by examiner

*Primary Examiner*—Susan S. Y. Lee
(74) *Attorney, Agent, or Firm*—Fitzpatrick, Cella, Harper & Scinto

(57) ABSTRACT

An image forming apparatus includes an image forming portion for forming an image on a recording material; a recording material bearing member for bearing and conveying the recording material toward the image forming portion; an attraction charging member that is disposed so as to come into contact with the recording material bearing member and induces charges to electrostatically attract the recording material onto the recording material bearing member; a power supply for supplying an electric current to the attraction charging member; and a control portion for changing a value of the electric current in accordance with the length of the recording material in a direction perpendicular to a recording material conveying direction.

24 Claims, 5 Drawing Sheets

IMAGE FORMING APPARATUS

BACKGROUND OF THE INVENTION

1. Field of the Invention

The present invention relates to an image forming apparatus such as a copying machine, a facsimile machine or a printer which forms an image on a recording material through an electrophotographic process to obtain a hard copy.

2. Related Background Art

Up to now, there have been proposed various image forming apparatuses each of which includes a plurality of image forming portions, forms toner images different in color from each other in the respective image forming portions, sequentially superimposes and transfers the toner images onto the same recording material, to thereby form a color image on the recording material. Under the circumstances, a color copying machine of the multi-color electrophotographic system using an endless recording material bearing member has been employed for high-speed recording.

In the color image forming apparatus of this type, image forming portions of four colors consisting of yellow, magenta, cyan and black are disposed along a transfer belt which is a belt-like recording material bearing member. Primary charging, image exposing and developing processes are conducted on photosensitive drums disposed in the respective image forming portions as image bearing members to form toner images of the respective colors. The toner images are superimposed and transferred onto a recording material which is attracted on the transfer belt and sequentially conveyed to transfer portions which are disposed opposite to the photosensitive drum of the respective image forming portions. Then, after the recording material onto which the toner images of four colors have been transferred is separated from the transfer belt, the toner image is fixed onto the transfer material to obtain a fixed image of full colors on the recording material.

The transfer belt is formed of a sheet made of dielectric resin such as polyethylene terephthalate resin (PET), polyvinylidene fluoride resin or polyurethane resins, and a belt in which both end portions of the sheet are permitted to lie one upon another and bonded into an endless shape or a seamless belt is used.

The recording material is extracted from a recording material cassette and then supplied onto the transfer belt through a plurality of conveying rollers and registration rollers, and then electrostatically attracted onto the transfer belt due to an attraction bias applied to an attraction charging means.

Note that the attraction charging means for the recording material as used is a non-contact charger such as a corona discharger or a contact charger using a charging member such as an electrically conductive blade, roller or brush.

For example, in the case where the attraction charging means is formed of the electrically conductive roller (attraction roller), after the recording material has been supplied to the transfer belt, the recording material is nipped together with the transfer belt between upper and lower attraction rollers that face each other through the transfer belt in the attraction portion, and the recording material is electrostatically attracted due to the action of the attraction bias applied to one of the attraction rollers.

However, when a small-sized recording material is going to be attracted, a current that flows due to the attraction bias is escaped to portions other than the recording material, charges that contributes to the attraction of the recording material onto the transfer belt decreases and the attraction of the recording material becomes insufficient, to thereby lead to a problem such as the recording material conveyance failure or the transfer failure.

SUMMARY OF THE INVENTION

The present invention has been made under the above circumstances, and therefore an object of the present invention is to provide an image forming apparatus that conveys a recording material stably while electrostatically attracting the recording material onto a recording material bearing member regardless of a size of the recording material so as to excellently form an image on the recording material without having an attraction failure or a transfer failure.

In order to achieve the above object, according to the present invention, there is provided an image forming apparatus comprising:

- image forming means for forming an image on a recording material;
- a recording material bearing member for bearing and conveying the recording material toward said image forming means;
- an attraction charging member that is disposed so as to come into contact with said recording material bearing member and gives charges to electrostatically attract the recording material onto said recording material bearing member;
- a power supply for supplying an electric current to said attraction charging member; and
- control means for changing a value of the electric current in accordance with the length of the recording material in a direction perpendicular to a recording material conveying direction.

BRIEF DESCRIPTION OF THE DRAWINGS

These and other objects and advantages of this invention will become more fully apparent from the following detailed description taken with the accompanying drawings in which.

DETAILED DESCRIPTION OF THE PREFERRED EMBODIMENTS

Now, a description will be given in more detail of preferred embodiments of the present invention with reference to the accompanying drawings.

(First Embodiment)

Figure 1:
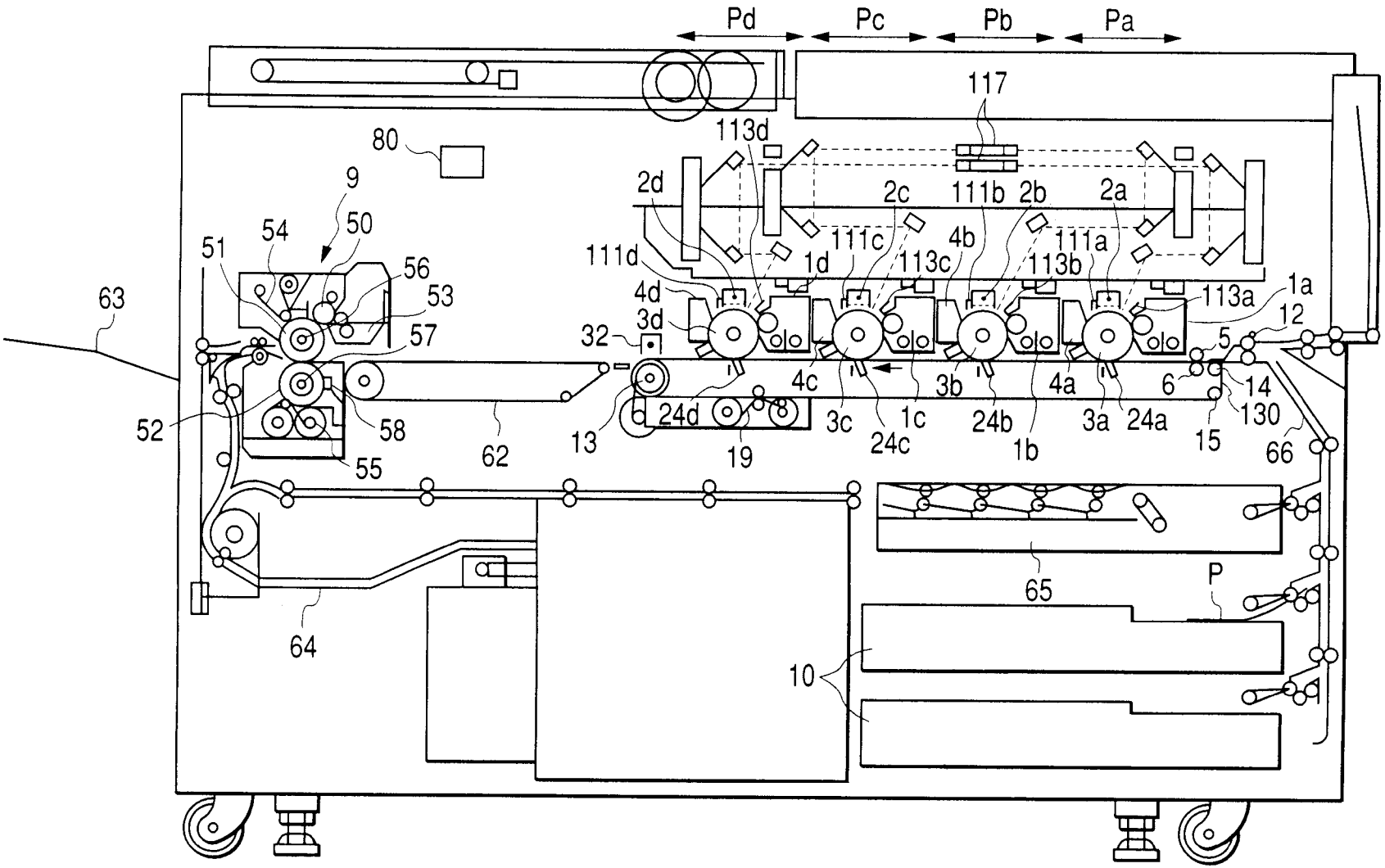
FIG. 1 is a cross-sectional view showing an image forming apparatus in accordance with an embodiment of the present invention.

FIG. 1 is a cross-sectional view showing an image forming apparatus in accordance with an embodiment of the present invention. This apparatus is structured by a full-color electrophotographic recording apparatus of four colors.

As shown in FIG. 1, in the interior of the image forming apparatus, a transfer belt 130 that is looped around a driving roller 13 and tension rollers 14, 15 is disposed as a belt-shaped recording material bearing member, and first, second, third and fourth image forming portions Pa, Pb, Pc and Pd are arranged side by side along the transfer belt 130. Toner images different in color from each other are formed in the respective image forming portions Pa to Pd through latent image forming, developing and transferring processes.

The respective image forming portions Pa, Pb, Pc and Pd are equipped with dedicated image bearing members, in this example, electrophotographic photosensitive drums 3*a*, 3*b*, 3*c* and 3*d*, respectively. In the outer periphery of the photosensitive drums 3*a*, 3*b*, 3*c* and 3*d* are disposed exposure lamps 111*a*, 111*b*, 111*c* and 111*d*, drum chargers 2*a*, 2*b*, 2*c* and 2*d*, potential sensors 113*a*, 113*b*, 113*c* and 113*d*, developing devices 1*a*, 1*b*, 1*c* and 1*d*, transfer chargers (transfer blades) 24*a*, 24*b*, 24*c* and 24*d*, and cleaners 4*a*, 4*b*, 4*c* and 4*d*. Above the apparatus are further disposed a light source device not shown and a polygon mirror 117.

A laser beam emitted from the light source device is scanned while rotating the polygon mirror 177, and the scanning light beam is deflected by a reflector mirror so as to be condensed in generatrix directions of the respective photosensitive drums 3*a*, 3*b*, 3*c* and 3*d* by an fθ lens to expose the respective drums, thereby forming electrostatic latent images on the respective photosensitive drums 3*a*, 3*b*, 3*c* and 3*d* in response to image signals.

The developing devices 1*a*, 1*b*, 1*c* and 1*d* are filled with toner of cyan, magenta, yellow and black as a developer by a predetermined amount by a supply device not shown. The developing devices 1*a*, 1*b*, 1*c* and 1*d* develop the latent images on the photosensitive drums 3*a*, 3*b*, 3*c* and 3*d*, respectively, to thereby visualize the latent images as a cyan toner image, a magenta toner image, a yellow toner image and a black toner image. The toner images of the respective colors on the respective photosensitive drums 3*a*, 3*b*, 3*c* and 3*d* are superimposed on each other and transferred on the recording material P which is attracted onto and conveyed by the transfer belt 130.

The recording material P is contained in the recording material cassette 10, and then supplied to the transfer belt 130 from the recording material cassette 10 through a plurality of conveying rollers and registration rollers 12, a conveying path 66, and so on. Then, the recording material P is electrostatically attracted onto the transfer belt 130 by the upper and lower attraction rollers 5 and 6 located at the attraction portion, and then sequentially conveyed by the transfer belt 130 to transfer portions in that the recording material P is opposed to the photosensitive drums 3*a*, 3*b*, 3*c* and 3*d* respectively.

The transfer belt 130 rotates by the driving roller 13, and when it is confirmed that the transfer belt 130 is put at a predetermined position, the recording material P is sent from the registration roller 12 to the transfer belt 130 so as to be conveyed toward the transfer portion of a first image forming portion Pa. At the same time, an image writing signal is turned on, and image formation is conducted on the photosensitive drum 3*a* of the first image forming portion Pa at a predetermined timing with reference to the image writing signal.

Then, a transfer charger 24*a* gives an electric field or charges on the transfer portion at a lower side of the photosensitive drum 3*a*, to thereby transfer the toner image of a first color formed on the photosensitive drum 3*a* onto the recording material P. The transfer allows the recording material P to be firmly borne on the transfer belt 130 by an electrostatic attractive force, and the recording material P is conveyed to a second image forming portion Pb and subsequent image forming portions.

The transfer charger 24 (24*a* to 24*d*) as used may be formed of a non-contact charger such as a corona discharger or a contact charger using a charging member such as an electrically conductive blade, roller or brush. In the non-contact charger, there arises such a problem in that because ozone is generated and charging is made through air, the non-contact charger is weak in fluctuation of the temperature and humidity environments of atmosphere whereby an image is not stably formed. The contact charger does not suffer from such a problem but has such advantages that the contact charger is ozoneless, strong in fluctuation of the temperature and humidity environments and high in image quality.

In this embodiment, the transfer blade 24 is employed as the transfer charger, and a transfer bias which is applied to the transfer blade 24 (24*a* to 24*d*) is controlled under constant current of the transfer current 10 $\mu$A. A process speed is set to 100 mm/sec.

The image formation and transfer on the second to fourth image forming portions Pb to Pd are the same as those on the first image forming portion Pa. Then, the recording material P to which the toner images of four colors have been transferred is separated from the end portion of the transfer belt 130 by eliminating electricity by a separation charger 32 at a downstream portion in the conveying direction of the transfer belt 130 to attenuate the electrostatic attractive force. The recording material P separated from the transfer belt 130 is conveyed to the fixing device 9 by the conveying portion 62.

The fixing device 9 is composed of a fixing roller 51, a pressure roller 52, heat-resistant cleaning members 54 and 55 for cleaning each of the fixing roller 51 and the pressure roller 52, heaters 56 and 57 disposed within the rollers 51 and 52, a coating roller 50 that coats a mold releasing oil such as dimethyl silicone oil on the fixing roller 51, an oil reservoir 53 and a thermistor 58 that detects a temperature of the surface of the pressure roller 52 to control the fixing temperature.

The recording material P to which the toner images of the four colors is delivered to a delivery tray 63 after the colors of the toner images are mixed and after the toner images are fixed by the fixing process onto the recording material P to form a copy image of full colors on the recording material P.

In the photosensitive drums 3*a*, 3*b*, 3*c* and 3*d* to which the toner images have been transferred, the non-transferred toner is cleaned and removed by the respective cleaners 4*a*, 4*b*, 4*c* and 4*d*, and the respective photosensitive drums then wait for a subsequent latent image formation. The toner and other foreign material remaining on the transfer belt 130 are wiped by bringing a cleaning web (non-woven fabric) 19 in contact with the surface of the transfer belt 130.

The above-described process is a one-side image forming process. The image forming apparatus according to this embodiment can conduct two-side image formation and is provided with a two-side image formation mode in addition to the one-side image formation mode.

In the two-side image formation mode, the recording material P that has been subjected to the fixing process in the one-side image forming process is fed to the conveying path 64 without being delivered to the delivery tray 63 and then fed to a duplex conveying path 65 by switch back operation.

Thereafter, the recording material P is again conveyed to the transfer belt 130 through the conveying path 66. The recording material P is put on the transfer belt 130 in such a manner that a front side (first side) of the recording material P onto which the toner image has been fixed is in contact with the transfer belt 130, and subsequently a toner image is transferred onto a back side (second side) of the recording material P, fixed and then delivered in the same manner as that in the one-side printing process.

Also, the image forming apparatus according to this embodiment can conduct image formation of black monochrome in addition to the full-color image formation and has a black monochrome image formation mode in addition to the color image formation mode.

In the color image formation mode, images are formed on the image forming portions Pa to Pd of yellow, magenta, cyan and black as described above, to thereby superimpose the images of four colors on the recording material. On the other hand, in the black monochrome image formation mode, the image is formed only on the image forming portion Pd of black, and no image is formed on the image forming portions Pa to Pc of other colors. The black monochrome image formation mode is set, thereby being capable of improving the throughput (productivity) of a copy and keeping the durability of the image forming portions of other colors.

The dielectric sheet material of the transfer belt 130 as generally used is a film-shaped sheet made of engineering plastic such as polyethylene terephthalate (PET), polyacetal, polyamide, polyvinyl alcohol, polyether ketone, polystyrene, polybutylene terephthalate, polymethyl pentene, polypropylene, polyethylene, polyphenylene sulfide, silicone resin, polyamide imide, polycarbonate, polyphenylene oxide, polyether sulfone, polysulfone, aromatic polyester, polyether imide, or aromatic polyimide.

In this embodiment, polyimide resin is applied from the viewpoints of mechanical characteristics, electrical characteristics, incombustibility, and the like, and an electrically conductive filler is added to the polyimide resin. The conductive filler is $10^{15}$ Ωcm in volume resistivity and 100 μm in thickness and of the seamless type.

The attraction charging means is composed of the upper and lower attraction rollers 5 and 6 as described above. The lower roller 6 is structured by coating an electrically conductive rubber on a core and so disposed as to be in contact with a back side (inner side) of the transfer belt 130. The lower roller 6 is connected with a high-voltage power supply for applying an attraction bias. The upper roller 5 is so disposed as to be in contact with the front side of the transfer belt 130 and to be opposed to the lower roller 6. The upper roller 5 is a counter pole of the lower roller 6, formed of a metal roller and grounded.

When the recording material is supplied to the transfer belt 130, the high-voltage power supply applies the attraction bias to the lower roller 6, and at the same time, the upper roller 5 and the lower roller 6 nip the transfer material therebetween together with the transfer belt 130, and electrostatically attract the transfer material to the transfer belt 130.

The above described respective controls of the image forming apparatus are conducted by control means 80.

Figure 2:
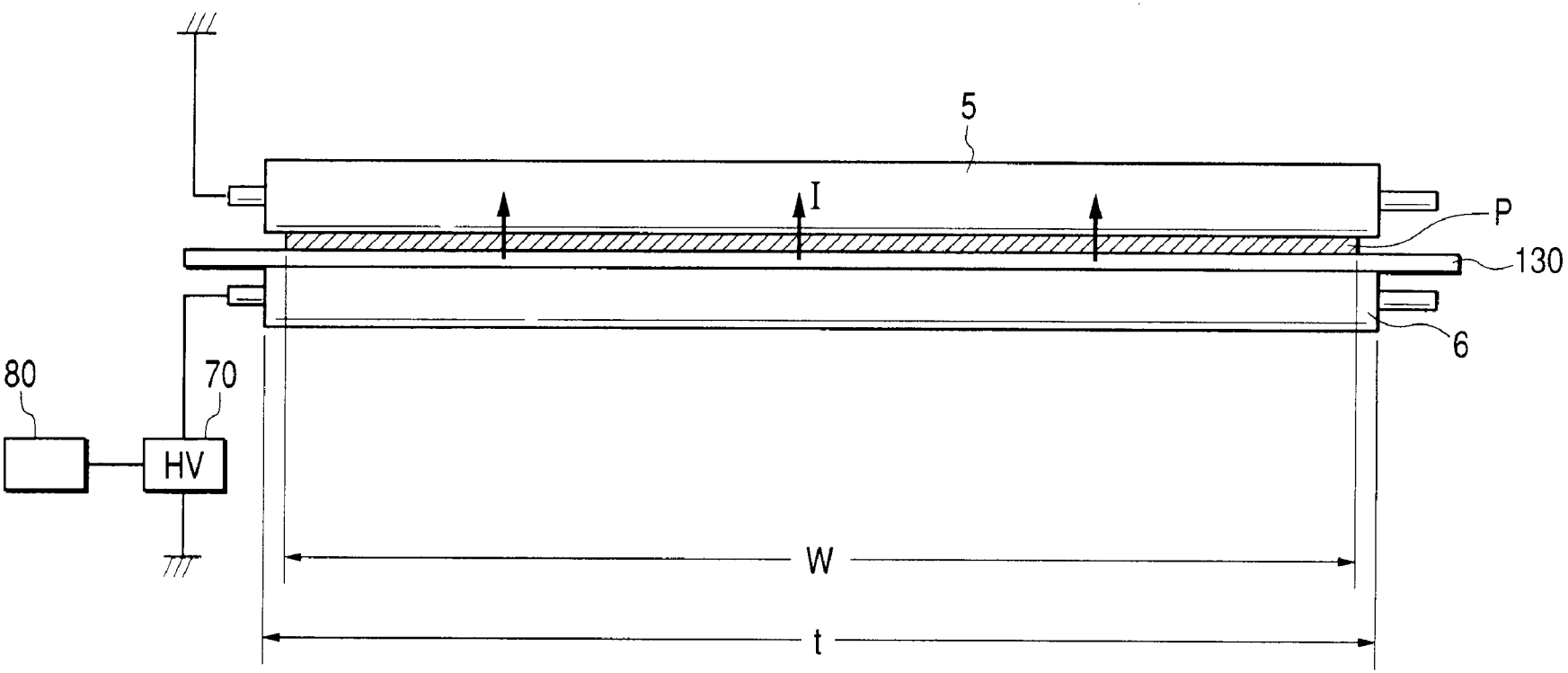
FIG. 2 is a cross-sectional view showing a recording material attracting portion in the image forming apparatus shown in FIG. 1.

Then, the attraction of the small-sized recording material will be described. FIG. 2 shows a cross-sectional view of the recording material attracting portion.

As shown in FIG. 2, the recording material P on the transfer belt 130 is nipped between the upper and lower attraction rollers 5 and 6 which are the attraction charging means on the attracting portion.

When the attraction bias is applied to the lower roller 6 for attraction from the high-voltage power supply 70 under the control of the control means 80, assuming that an attracting electric current that flows in the attracting portion is I [μA], the width of the recording material P is W [cm] and a process speed is v [cm/sec], the surface charge density ρ [$\mu C/cm^2$] on the recording material P becomes $\rho = I/(W \times v)$.

When the charges are induced in the recording material P so that the surface charge density ρ of the recording material becomes a predetermined value or more, the attraction of the recording material to the transfer belt 130 is stably conducted.

Even in the case where the small-sized recording material passes, in order to suitably conduct the attraction, the surface charge density on the recording material must be set to the same value as that in the case of passing a largest-sized recording material, or more. FIG. 3A shows the attracting portion when the small-sized recording material passes and FIG. 3B shows an equivalent circuit of the attracting portion.

As shown in FIG. 3A, assuming that in the attracting portion, a current that flows in a sheet passing portion at which the small-sized recording material P is positioned is Ip [μA], a current that flows in a non-sheet passing portion where no recording material P exists is Iq [μA], the recording material width is p [cm], the width of the non-sheet passing portion is q [cm] and the charged width of the attraction roller pair is t [cm], then $\rho = Ip/(p \times v) = I/(t \times v)$ must be satisfied. The charged width t is $t \approx W$, that is, substantially the same as the largest-sized recording material width W.

Figure 3B:
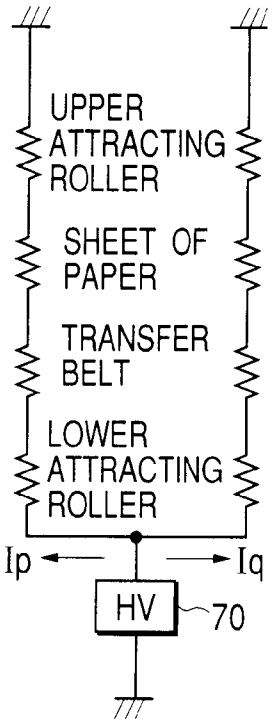
FIGS. 3A and 3B are diagrams showing the recording material attracting portion at the time of attracting a small-size recording material and its equivalent circuit.
Figure 3A:
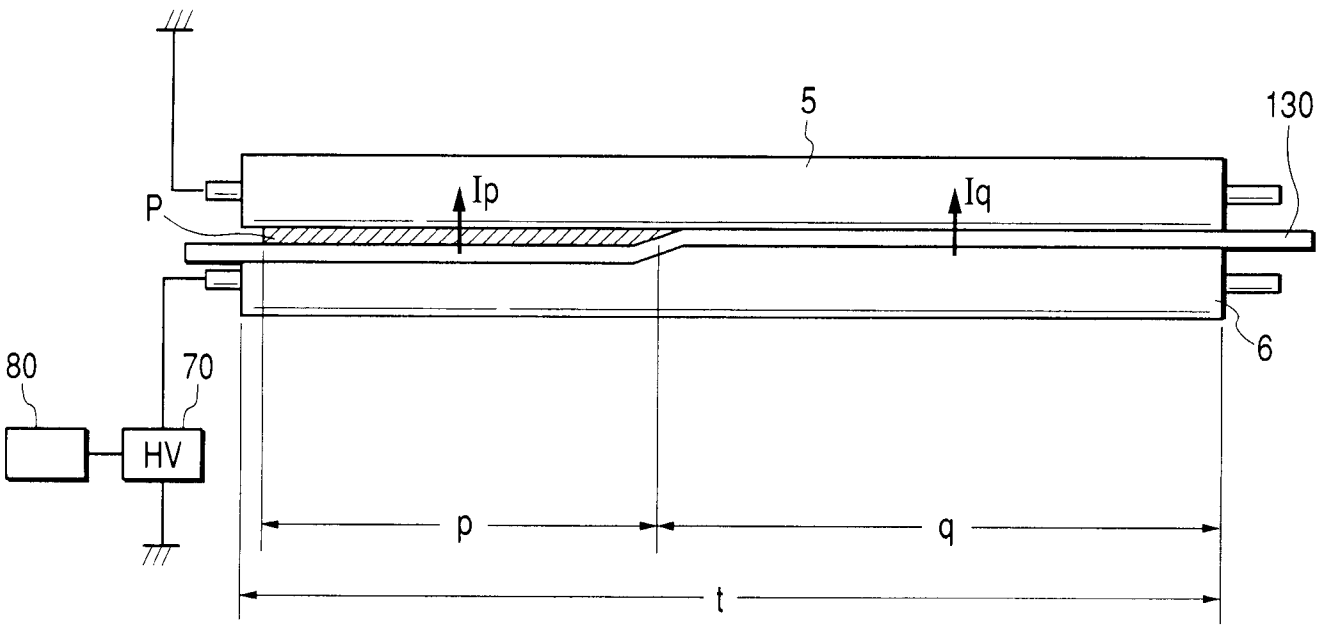

However, as shown in the equivalent circuit of FIG. 3B, because the sheet-passing portion has the resistance of the recording material (paper) per se, the impedance becomes high as compared with the non-sheet passing portion. For that reason, a current per a unit area which flows in the sheet passing portion is also small as compared with the non-sheet passing portion, that is, the surface charge density on the recording material becomes also small as compared with the non-sheet passing portion. For that reason, the surface charge density on the recording material becomes insufficient and the attractive force lessens, to thereby lead to such a problem in that the conveying property of the recording material is deteriorated and jamming occurs.

That is, in fact, $Iq/(q \times v) > I/(t \times v) > Ip/(p \times v)$ is accomplished, and therefore the sheet-passing portion is short in the surface charge density and the non-sheet passing portion is excessive in the surface charge density.

The above phenomenon is liable to occur particularly in the case where the recording material which is dried under a low humidity environment (for example, 23° C. and 5% RH) and becomes high in resistance is attracted. In general, the volume resistivity of the recording material is changed from about $1 \times 10^7$ to the extent of about $1 \times 10^{14}$ Ωcm depending on the kind of recording material and the temperature and humidity conditions. However, the transfer belt is formed of a dielectric resin sheet, and the volume resistivity of the transfer belt is changed by only one to three orders of magnitude even depending on the temperature and humidity conditions. Also, in the transfer belt of the type low in the volume resistivity whose resistance is adjusted by the effect of an addition agent, the above phenomenon is further liable to occur.

When the small-sized recording material is thus allowed to pass, a large amount of current flows in the non-sheet passing portion small in resistivity and a current that flows in the sheet-passing portion becomes short, resulting in an attraction failure. The recording material becomes very high in volume resistivity under the low humidity environment, and even in such a case, the above-described attraction failure occurs if the surface charge density is not equal to or more than that on the largest-sized recording material.

The reason that the surface charge density on the small-sized recording material in attraction needs to be equal to or more than that of the largest-sized recording material is that the total charge amount on the small-sized recording material which is small in area is less than that of the largest-sized recording material, and the absolute attraction force is small. For that reason, there is a case where it is better to increase the surface charge density in the small-sized sheet.

Therefore, assuming that a current that flows in a region where the recording material exists is Ip [$\mu$A], the length of the recording material is p [cm], and the recording material conveying speed is v [cm/sec], the charge density $\rho$ [$\mu C/cm^2$] on the recording material which is calculated by $\rho = Ip/(p \times v)$ may satisfy the condition of $\rho max \leqq \rho small$ when a value of the charge density is $\rho max$ when the length of the recording material is the longest that can be used in the image forming apparatus, and a value of the charge density is $\rho small$ when the length of the recording material is shorter than the longest.

Under the above circumstances, the present invention conducts the control of the attracting electric current using the width of the recording material.

Figure 4:
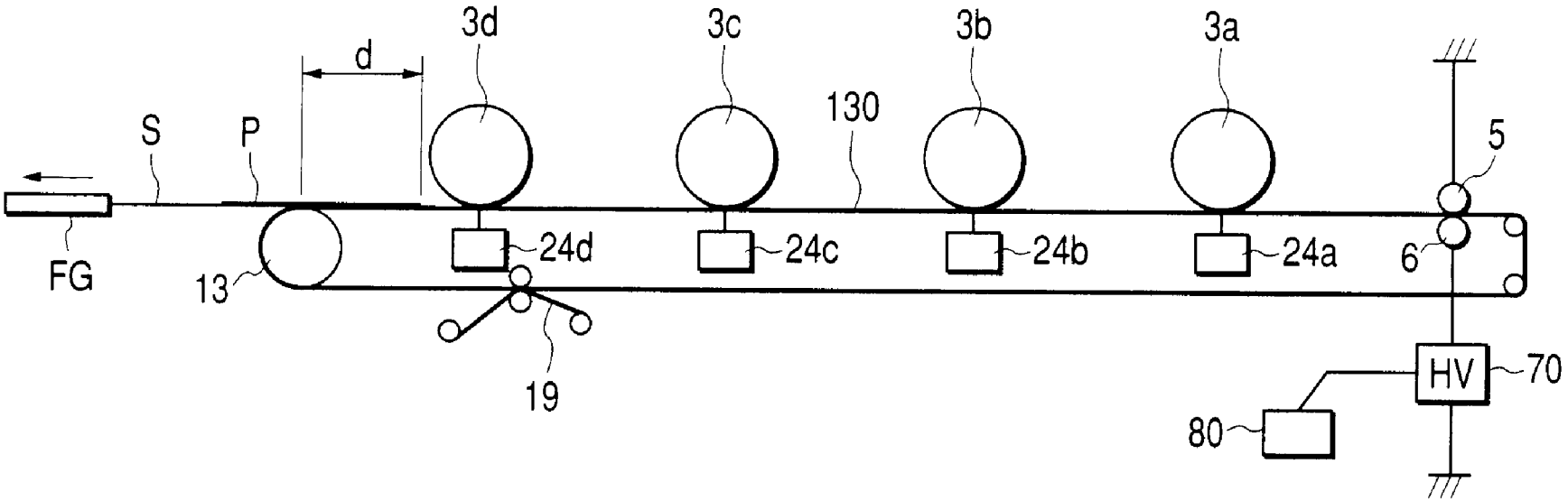
FIG. 4 is an explanatory diagram showing a method of measuring an attracting force of the recording material in accordance with the present invention.

In the present invention, the attractive force of the recording material is measured as shown in FIG. 4. First, when the recording material P is attracted to the transfer belt 130 and conveyed, and starts to be separated from the transfer belt 130 when reaching an end portion of the transfer belt 130 as in the normal image formation, the rotation of the transfer belt 130 stops. At this time, the rotation stops so that a length d of a portion of the recording material P which is stuck onto the transfer belt 130 is kept constant. In this situation, a force gauge FG (or a spring balance) is connected to a leading end of the recording material P through a rope S in the above state, and then pulled in a moving direction of the recording material P until the recording material P is peeled off. A value of the force gauge FG exhibits a peak value at the moment the recording material is peeled off from the transfer belt, and the peak value of the force gauge is defined as the attractive force.

The control of the attracting electric current according to the recording material width in this embodiment will be described with reference to FIGS. 5A and 5B. FIG. 5A shows a case of a comparative example (Ref) in which the attracting electric current is held constant to 5.0 $\mu$A regardless of the width (thrust width, that is, the width of the recording material in a direction orthogonal to the conveying direction of the transfer belt) as in the conventional example.

Figure 5B:
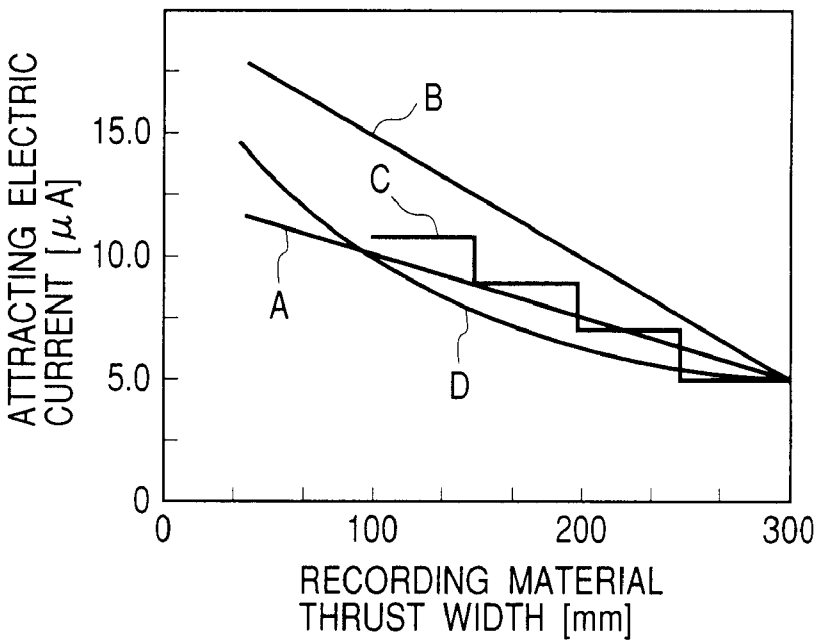
FIGS. 5A and 5B are explanatory diagrams showing a method of controlling an attracting electric current with respect to a recording material width in the embodiment shown in FIG. 1 as compared with a conventional example.
Figure 5A:
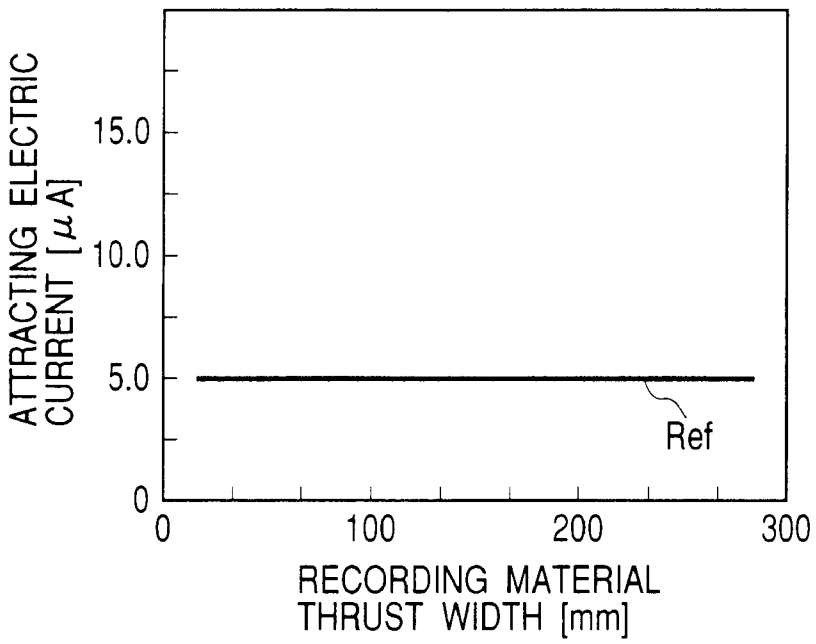

FIG. 5B shows a case of the present invention in which a straight line A inclined in FIG. 5B exhibits that the attracting electric current straightly increases with the limit of 5.0 $\mu$A to 10.0 $\mu$A in proportion to a decrease of the recording material width assuming that the attracting electric current is 5.0 $\mu$A when the recording material width is the maximum value of 297 mm and 10.0 $\mu$A when the recording material width is 100 mm. An inclined straight line B exhibits that the attracting electric current straightly increases with a decrease of the recording material width assuming that the attracting electric current is 5.0 $\mu$A when the recording material width is the maximun value of 297 mm and 15.0 $\mu$A when the recording material width is 100 mm.

A hierarchical polygonal line C exhibits that the attracting electric current hierarchically increases with respect to a decrease of the recording material width assuming that the attracting electric current is 5.0 $\mu$A when the recording material width is 297 to 250 mm, 7.0 $\mu$A when it is 250 to 200 mm, 9.0 $\mu$A when it is 200 to 150 mm, and 11.0 $\mu$A when it is 150 to 100 mm. A curve line D exhibits that the attracting electric current increases within the limit of 5.0 to 11.0 $\mu$A in such a manner that it is curved so as to be projected downward with respect to a decrease of the recording material width assuming that the attracting electric current is 5.0 $\mu$A when the recording material width is 297 mm and 11.0 $\mu$A when it is 100 mm.

The results of measuring the attractive force under the above attracting electric current conditions are shown in Table 1.

TABLE 1

| | Thrust Width [mm] | | | | | |
|---|---|---|---|---|---|---|
| | A4 Landscape/A3 297 | B4R 257 | A4R 210 | B5R 182 | A5R 148 | Postcard 100 |
| Attracting Electric Current [$\mu$A] | | | | | | |
| Ref | 5.0 | 5.0 | 5.0 | 5.0 | 5.0 | 5.0 |
| Embodiment 1 | | | | | | |
| A | 5.0 | 6.0 | 7.2 | 7.9 | 8.8 | 10.0 |
| B | 5.0 | 7.0 | 9.4 | 10.8 | 12.6 | 15.0 |
| C | 5.0 | 5.0 | 7.0 | 9.0 | 11.0 | 11.0 |
| D | 5.0 | 5.5 | 6.2 | 7.3 | 9.0 | 11.0 |
| Attractive Force [kgf]/[N] | | | | | | |
| Ref | 4.0/39.2 | 3.8/37.2 | 3.0/29.4 | 2.8/27.4 | 2.0/19.6 | 1.1/10.8 |
| Embodiment 1 | | | | | | |
| A | 4.0/39.2 | 3.9/38.2 | 3.7/36.3 | 3.5/34.3 | 3.0/29.4 | 2.0/19.6 |
| B | 4.0/39.2 | 4.0/39.2 | 3.9/38.2 | 3.7/36.3 | 3.5/34.3 | 3.0/29.4 |
| C | 4.0/39.2 | 3.8/37.2 | 3.7/36.3 | 3.6/35.3 | 3.4/33.3 | 2.2/21.6 |
| D | 4.0/39.2 | 3.9/38.2 | 3.3/32.3 | 3.4/33.3 | 3.1/30.4 | 2.2/21.6 |

TABLE 1-continued

| | Thrust Width [mm] | | | | | |
|---|---|---|---|---|---|---|
| | A4 Landscape/A3 297 | B4R 257 | A4R 210 | B5R 182 | A5R 148 | Postcard 100 |
| Embodiment 2 A' | 4.1/40.2 | 4.0/39.2 | 3.9/38.2 | 3.7/36.3 | 3.5/34.3 | 2.4/23.5 |
| Embodiment 3 B' | 2.2/21.6 | 2.2/21.6 | 2.0/19.6 | 2.0/19.6 | 1.7/16.7 | 1.5/14.7 |

As shown in Table 1, in the conventional example (Ref) in which the attracting electric current is kept constant regardless of the recording material width, the attractive force drops down to the extent of about ¼ as the width of the recording material reduces. On the contrary, in the present invention, control is made in such a manner that the attracting electric current increases in proportion to a decrease in the recording material width, and in any control methods of A to D, even in a small-sized sheet such as a postcard, the attractive force of 19.6 N (2 kgf) or more is exhibited.

In this embodiment, as described above, since a bias that is applied to the attraction charging means changes in accordance with the recording material width, a sufficient attractive force is obtained, thereby being capable of significantly reducing the recording material conveyance failures or the image failures caused by the conveyance failures.

In the above description, the attraction bias is applied from the inside of the transfer belt, but may be applied from the outside thereof. Also, the attraction charging means is not limited to the charging roller.

(Second Embodiment)

In the first embodiment, when the recording material P is electrostatically attracted onto the transfer belt 130, the attracting electric current of the bias which is applied to the attraction charging means is controlled with respect to the recording material width, and the image formation is a one-side image formation which is conducted to only one side of the recording material.

However, as described above, the image forming apparatus shown in FIG. 1 which is used in the first embodiment includes a two-side image formation mode in addition to the one-side image formation mode, thereby being capable of forming images on both sides of the recording material. In this embodiment, when the two-side image formation is conducted in the image forming apparatus shown in FIG. 1, the recording material P is attracted without controlling the attracting electric current with respect to the recording material width at the time of forming an image on a first side, and the attracting electric current is controlled in accordance with the recording material width to attract the recording material P at the time of forming an image on a second side as in the first embodiment.

The flatness of the recording material is good in the first side, and even in the small-sized recording material, there arises no problem in the attraction and conveyance of the recording material by the transfer belt 130. However, even in such a recording material, there are many cases where the recording material that has passed the fixing device 9 once is deteriorated in flatness and curled, and there is a case where the recording material attraction failure occurs only on the second side.

In the above Table 1, A' denotes the attractive force in case of this embodiment where the attractive force on the second side is measured under the same attracting electric current conditions as those in A of the first embodiment. As a result, control is conducted on the attracting electric current with respect to the recording material width in the second-side image formation as in this embodiment, thereby being capable of attracting the small-sized recording material to the transfer belt 130 by a sufficient attractive force to form an image on the second side.

(Third Embodiment)

In the first embodiment, four-full-color image is formed on the recording material P, and the image forming apparatus shown in FIG. 1 and described in the first embodiment includes a black monochrome image formation mode in addition to the full-color image formation mode as described above.

This embodiment is characterized in that the recording material width of the attraction charging means is changed over in accordance with the image formation mode of the image forming apparatus shown in FIG. 1.

In the full-color image formation mode, since not only the attracting electric current but also the transfer currents of four colors are added to the recording material and the transfer belt, the attractive force between the recording material and the transfer belt becomes larger, to thereby make it difficult to generate the failure of attraction of the recording material onto the transfer belt. However, in the black monochrome image formation mode, since only the attracting electric current is supplied to the recording material and the transfer belt, the attractive force becomes smaller than that in the full-color image formation mode, to thereby make it easy to generate the failure of attraction of the recording material.

In the above Table 1, B' denotes an attractive force in case of this embodiment, where the attractive force in the black monochrome image formation mode is measured under the same attracting electric current conditions as that of B in the first embodiment. As a result, the control of the attracting electric current is conducted with respect to the recording material width even at the time of the black monochrome image formation mode, thereby being capable of attracting the small-sized recording material onto the transfer belt 130 by a sufficient attractive force to form a black monochrome image on the recording material.

The above description is given of the first to third embodiments, and numeric values of the attracting electric current mentioned in those embodiments are merely examples and an optimum attracting electric current can be appropriately changed in accordance with the kind of recording material. Also, in the case where the image forming apparatus includes a plurality of image formation modes different in process speed, the optimum attracting electric current may be changed in accordance with the selected mode.

The image bearing member is not limited to the electrophotographic photosensitive member but may be a dielectric in electrostatic recording. Also, the recording material bearing member may not be the transfer belt but may be a transfer drum.

In general, the developing means is roughly classified into four types consisting of a mono-component contact developing method in which a non-magnetic toner is coated on a sleeve by a blade or the like, or a magnetic toner is coated on a sleeve by a magnetic force, and the toner is carried to a developing portion that is opposed to the image bearing member and the toner is developed with respect to the image bearing member in a contact state, a mono-component non-contact developing method in which the toner is developed with respect to the image bearing member in a non-contact state, a two-component contact developing method in which the mixture of toner with magnetic carrier is employed as a developer, and the developer is borne on a sleeve by a magnetic force and carried to the developing portion, and the developer is developed with respect to the image bearing member in a contact state, and a two-component non-contact developing method that develops the image bearing member in a non-contact state. In the present invention, the developing means may be any one of the above methods. The two-component contact developing method is frequently used from the viewpoints of the image high quality and the high stability.

As was described above, according to the present invention, the recording material is stably electrostatically attracted on the recording material bearing member and conveyed regardless of the size of the recording material, thereby being capable of excellently forming an image on a recording material without causing the attraction failure or the transfer failure.

The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An image forming apparatus comprising:

image forming means for forming an image on a recording material;

a recording material bearing member for bearing and conveying the recording material toward said image forming means;

an attraction charging member that is disposed so as to come into contact with said recording material bearing member and induces charges to electrostatically attract the recording material onto said recording material bearing member;

a power supply for supplying an electric current to said attraction charging member; and control means for changing a value of the electric current in accordance with a length of the recording material in a direction perpendicular to a recording material conveying direction.

2. An image forming apparatus according to claim 1, wherein the value of the electric current is set to be larger as the length of the recording material is shorter.

3. An image forming apparatus according to claim 2, wherein a relation between the length of the recording material and the value of the electric current is that a rate of change in the value of the electric current with respect to a rate of change in the length of the recording material is constant.

4. An image forming apparatus according to claim 2, wherein a relation between the length of the recording material and the value of the electric current is that a rate of increase in the value of the electric current becomes higher as the length of the recording material is shorter.

5. An image forming apparatus according to claim 2, wherein a relation between the length of the recording material and the value of the electric current is that the value of the electric current changes for each predetermined range of the length of the recording material.

6. An image forming apparatus according to claim 2, wherein assuming that, at a position in which the recording material is attracted, an electric current that flows in a region where the recording material exists is Ip [$\mu$A], the length of the recording material is p [cm], and a recording material conveying speed is v [cm/sec], a charge density $\rho$ [$\mu C/cm^2$] on the recording material which is calculated on the basis of $\rho = Ip/(p \times v)$ satisfies a condition of $\rho max \leqq \rho small$, wherein a value of the charge density is $\rho max$ when the length of the recording material is a longest that can be used in the image forming apparatus, and a value of the charge density is $\rho small$ when the length of the recording material is shorter than the longest.

7. An image forming apparatus according to any one of claims 1 to 6, wherein said attraction charging member is in contact with a surface opposite to a recording material retaining surface of said recording material bearing member.

8. An image forming apparatus according to any one of claims 1 to 6, wherein said attraction charging member is in contact with a recording material retaining surface of said recording material bearing member.

9. An image forming apparatus comprising:

image forming means for forming an image on a recording material;

a recording material bearing member for bearing and conveying the recording material toward said image forming means;

an attraction charging member that is disposed so as to come into contact with said recording material bearing member and induces charges to electrostatically attract the recording material onto said recording material bearing member;

a power supply for supplying an electric current to said attraction charging member; and control means for controlling a value of the electric current, wherein said image forming apparatus has a first side mode for forming an image on one side of the recording material, and a second side mode for forming an image on another side of the recording material opposite to the one side on which the image has been formed, and wherein said control means changes the value of the electric current in accordance with a length of the recording material in a direction perpendicular to a recording material conveying direction in the second side mode.

10. An image forming apparatus according to claim 9, wherein the value of the electric current is set to be larger as the length of the recording material is shorter.

11. An image forming apparatus according to claim 10, wherein a relation between the length of the recording material and the value of the electric current is that a rate of change in the value of the electric current with respect to a rate of change in the length of the recording material is constant.

12. An image forming apparatus according to claim 10, wherein a relation between the length of the recording material and the value of the electric current is that a rate of increase in the value of the electric current becomes higher as the length of the recording material is shorter.

13. An image forming apparatus according to claim 10, wherein a relation between the length of the recording material and the value of the electric current is that the value of the electric current changes for each predetermined range of the length of the recording material.

14. An image forming apparatus according to claim 10, wherein assuming that, at a position in which the recording material is attracted, an electric current that flows in a region where the recording material exists is Ip [$\mu$A], the length of the recording material is p [cm], and a recording material conveying speed is v [cm/sec], a charge density $\rho$[$\mu$C/cm$^2$] on the recording material which is calculated on the basis of $\rho$=Ip/(p×v) satisfies a condition of $\rho max \leqq \rho small$, wherein a value of the charge density is $\rho max$ when the length of the recording material is a longest that can be used in the image forming apparatus, and a value of the charge density is $\rho small$ when the length of the recording material is shorter than the longest.

15. An image forming apparatus according to any one of claims 9 to 14, wherein said attraction charging member is in contact with a surface opposite to a recording material retaining surface of said recording material bearing member.

16. An image forming apparatus according to any one of claims 9 to 14, wherein said attraction charging member is in contact with a recording material retaining surface of said recording material bearing member.

17. An image forming apparatus comprising:

a plurality of image forming means each for forming an image on a recording material;

a recording material bearing member for bearing and conveying the recording material toward said plurality of image forming means;

an attraction charging member that is disposed so as to come into contact with said recording material bearing member and induces charges to electrostatically attract the recording material onto said recording material bearing member;

a power supply for supplying an electric current to said attraction charging member; and control means for controlling a value of the electric current, wherein said image forming means has a plural-color mode in which said plurality of image forming means form and superimpose images on the recording material which is borne and conveyed by said recording material bearing member, and a monochrome mode in which one of said plurality of image forming means form an image on the recording material which is borne and conveyed by said recording material bearing member, wherein said control means changes the value of the electric current in accordance with the length of the recording material in a direction perpendicular to a recording material conveying direction in the monochrome mode.

18. An image forming apparatus according to claim 17, wherein the value of the electric current is set to be larger as the length of the recording material is shorter.

19. An image forming apparatus according to claim 18, wherein a relation between the length of the recording material and the value of the electric current is that a rate of change in the value of the electric current with respect to a rate of change in the length of the recording material is constant.

20. An image forming apparatus according to claim 18, wherein a relation between the length of the recording material and the value of the electric current is that a rate of increase in the value of the electric current becomes higher as the length of the recording material is shorter.

21. An image forming apparatus according to claim 18, wherein a relation between the length of the recording material and the value of the electric current is that the value of the electric current changes for each predetermined range of the length of the recording material.

22. An image forming apparatus according to claim 18, wherein assuming that, at a position in which the recording material is attracted, an electric current that flows in a region where the recording material exists is Ip [$\mu$A], the length of the recording material is p [cm], and a recording material conveying speed is v [cm/sec], a charge density $\rho$ [$\mu$C/cm$^2$] on the recording material which is calculated on the basis of $\rho$=Ip/(p×v) satisfies a condition of $\rho max \leqq \rho small$, wherein a value of the charge density is $\rho max$ when the length of the recording material is a longest that can be used in the image forming apparatus, and a value of the charge density is $\rho small$ when the length of the recording material is shorter than the longest.

23. An image forming apparatus according to any one of claims 17 to 22, wherein said attraction charging member is in contact with a surface opposite to a recording material retaining surface of said recording material bearing member.

24. An image forming apparatus according to any one of claims 17 to 22, wherein said attraction charging member is in contact with a recording material retaining surface of said recording material bearing member.

* * * * *

UNITED STATES PATENT AND TRADEMARK OFFICE

CERTIFICATE OF CORRECTION

PATENT NO. : 6,449,454 B1
DATED : September 10, 2002
INVENTOR(S) : Yoshikuni Ito It is certified that error appears in the above-identified patent and that said Letters Patent is hereby corrected as shown below:

Column 2,
Line 2, “charges” should read -- charge --.

Column 3,
Line 22, “not shown” should read -- (not shown) --; and
Line 33, “not shown.” should read -- (not shown). --.

Column 14,
Line 1, “form” should read -- forms --.

Signed and Sealed this

Eighteenth Day of February, 2003

JAMES E. ROGAN
*Director of the United States Patent and Trademark Office*